US006564030B2

(12) United States Patent
Baughman et al.

(10) Patent No.: US 6,564,030 B2
(45) Date of Patent: May 13, 2003

(54) VENTED SKIVE ASSEMBLY FOR A FUSER STATION IN AN IMAGE-FORMING MACHINE

(75) Inventors: Richard C. Baughman, Geneseo, NY (US); Terry N. Morganti, Brockport, NY (US); James V. Orchard, II, Holley, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/736,656

(22) Filed: Dec. 13, 2000

(65) Prior Publication Data

US 2002/0071699 A1 Jun. 13, 2002

(51) Int. Cl.[7] ..... G03G 15/20
(52) U.S. Cl. ..... 399/323; 399/91
(58) Field of Search ..... 399/323, 322, 399/91, 92, 94, 97, 98; 271/306–11, 900

(56) References Cited

FOREIGN PATENT DOCUMENTS

| | | | |
|---|---|---|---|
| JP | 54-65550 | * | 5/1979 |
| JP | 6-43772 | * | 2/1994 |
| JP | 6-118818 A | * | 4/1994 |

* cited by examiner

*Primary Examiner*—Joan Pendegrass

(57) ABSTRACT

This invention provides a fuser station with a vented skive assembly for an image-forming machine. The image-forming machine may have a photoconductor, a primary charger, an exposure machine, a toning station, a transfer charger, and a vented fuser station. The fuser station may include a pressure roller, a fuser roller, and a skive assembly. The skive assembly has rib sections forming one or more slots, which are configured to provide an airflow pattern to reduce condensation. The skive assembly may have an insert protection device disposed in one or more of the slots.

50 Claims, 13 Drawing Sheets

VENTED SKIVE ASSEMBLY FOR A FUSER STATION IN AN IMAGE-FORMING MACHINE

FIELD OF THE INVENTION

This invention generally relates to fuser stations for image-forming machines. More particularly, this invention relates to fuser stations having a vented skive assembly to reduce the condensation of water vapor in the fuser station.

BACKGROUND OF THE INVENTION

An image-forming machine transfers images onto paper or other medium. The image-forming machine usually includes a photoconductor, one or more chargers, an exposure machine, a toning station, a fuser station, and a cleaner. The image-forming machine also has an environmental system, which may be an air exchanger, fan, or similar device to pull or push air through the image-forming machine.

Generally, the photoconductor is selectively charged and optically exposed to form an electrostatic latent image on the surface. Toner is deposited onto the photoconductor surface. The toner is charged, thus adhering to the photoconductor surface in areas corresponding to the electrostatic latent image. The toner image is transferred onto a sheet of paper or other medium. In the fuser station, the sheet is heated causing the toner to fix or adhere to the paper or other medium. The photoconductor is refreshed, cleaned to remove residual toner and charge, and is then ready to make another image. The sheet exits the image-forming equipment.

FIG. 13 shows a side view of a typical fuser station for an image-forming machine according to the prior art. The fuser station has a fuser roller, a pressure roller, and upper and lower skive assemblies. FIG. 14 is a perspective view of an upper skive assembly according to the prior art. The fuser and pressure rollers are disposed to form a nip or pinch region. The pressure roller rotates counterclockwise as indicated by the arrow A. The fuser roller rotates clockwise as indicated by arrow B. One or more heater rollers (not shown) heat the fuser roller. The pressure roller also may be heated. The upper and lower skive assemblies are disposed adjacent to the nip region to help remove and guide the sheet away from the pressure and fuser rollers. The upper skive assembly has finger portions that project toward the nip region.

The fuser station causes the toner to fix or adhere to the sheet. In this fixing process, a sheet of paper or other medium passes through the pressure and fuser rollers in the direction indicated by arrow C. As the sheet passes through the rollers, the constriction of the nip region presses the toner onto the surface of the sheet. At the same time, the fuser roller transfers heat to the sheet, causing the toner to fuse to the sheet. The rotation of the rollers pulls the sheet through the nip region.

The constriction and pressure of the rollers and the heating of the toner in the nip region may cause the sheet to stick or attach to the pressure roller. However, the leading edge of the sheet is guided between the upper and lower skive assemblies. If the sheet is stuck to the pressure roller, the finger portions of the upper skive assembly catch the leading edge of the sheet. The finger portions guide the leading edge between the upper and lower skive assemblies, thus pulling the sheet away from the pressure roller as the sheet moves out of the nip region.

The fixing process is usually done at about 355° F. At this temperature, water evaporates or is driven out of the sheet in the form of water vapor. The water vapor condenses in condensation zones on the surface of the upper skive assembly. The condensed water vapor forms droplets that trickle down the upper skive assembly. The droplets may fall onto a sheet as it passes under the upper skive assembly. The water droplets cause the sheet to swell and leave a deformed spot or track on the sheet. The result is a visual defect on the sheet.

The quantity of water vapor is highly dependent upon the moisture content of the paper. If the moisture content is less than about five percent by weight, there may be less condensation on the upper skive assembly. If the moisture content is more than about five percent by weight, there may be more condensation on the upper skive assembly. The amount of condensation also depends on the number of sheets in an image-forming job. Condensation may accumulate in an image-forming job having a large number of sheets even though the moisture content is low. While the first sheets may be clean, the later sheets may have water droplet defects.

There are several approaches to eliminate or minimize condensation on the upper skive assembly. The image-forming machine may be restricted to use only low moisture paper. However, it is impracticable if not impossible for a user of the image-forming machine to determine the moisture content of the paper or other medium immediately prior to use. The storage method and humidity often affect the moisture content, causing it to vary from time to time. Additionally, the moisture content of the paper or other medium may be reduced or lowered. However, the equipment and time required makes this approach impracticable. It also is impracticable for a user to limit the size of image-forming jobs.

The upper skive assembly or a nearby part may be maintained at a temperature high enough to eliminate the cold surfaces where condensation may occur. However, additional equipment is required such as heating elements or the like for upper skive assembly or the other part. The higher temperature also may expand or distort the upper skive assembly, causing the finger portions to project too far or unevenly into the nip region. Additionally, the energy required to heat the upper skive assembly or other part increases operating costs for the image-forming machine.

The fuser station also may have additional venting or increased airflow to remove water vapor before condensation occurs. The additional venting and increased airflow may require additional equipment such as a larger environmental system or fan. In addition, the configuration of the upper skive assembly may create "dead" zones where the air does not flow well. The water vapor may accumulate and condense in these dead zones rather than flow out of the fuser station.

Accordingly, there is a need for a fuser station in an image-forming machine that reduces the condensation of water vapor.

SUMMARY

This invention provides a fuser station with a vented skive assembly for an image-forming machine. The skive assembly has one or more slots that provide an airflow pattern to reduce condensation in the fuser station. The heat used during the fixing process in the image-forming machine may evaporate water from a sheet. The environmental system or other convective airflows in the image forming machine pass the water vapor through the one or more slots.

The image-forming machine may have a photoconductor, a primary charger, an exposure machine, a toning station, a transfer charger, and a vented fuser station. The primary charger electrostatically charges the photoconductor. The exposure machine optically exposes and forms an electrostatic image on the photoconductor. The toning station applies toner onto the photoconductor. The toner has a charge to adhere to the electrostatic image. The transfer charger transfers the toner from the photoconductor onto a sheet. The fuser station receives the sheet from the transfer charger and fuses the toner onto the sheet.

The fuser station may include a pressure roller, a fuser roller, and a skive assembly. The fuser roller forms a nip region with the pressure roller. The skive assembly catches the sheet as it advances out of the nip region in a sheet direction. The skive assembly has rib sections, which may project from the skive assembly toward the nip region. One or more finger portions may provide the rib sections. The skive assembly also may have a support member connected to the rib sections and the finger portions. The rib sections form one or more slots, which are configured to provide an airflow pattern that reduces condensation on the skive assembly. The skive assembly may have an insert protection device disposed in one or more of the slots. The insert protection device prevents or corrects a sheet stubbing the slot.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

FIGS. 12A and 12B are close-up bottom views of a finger portion for the upper skive assembly shown in FIG. 6: in which, FIG. 12A shows a tab section; and FIG. 12B does not show a tab section.

DETAILED DESCRIPTION OF THE PREFERRED EMBODIMENTS

Figure 1:
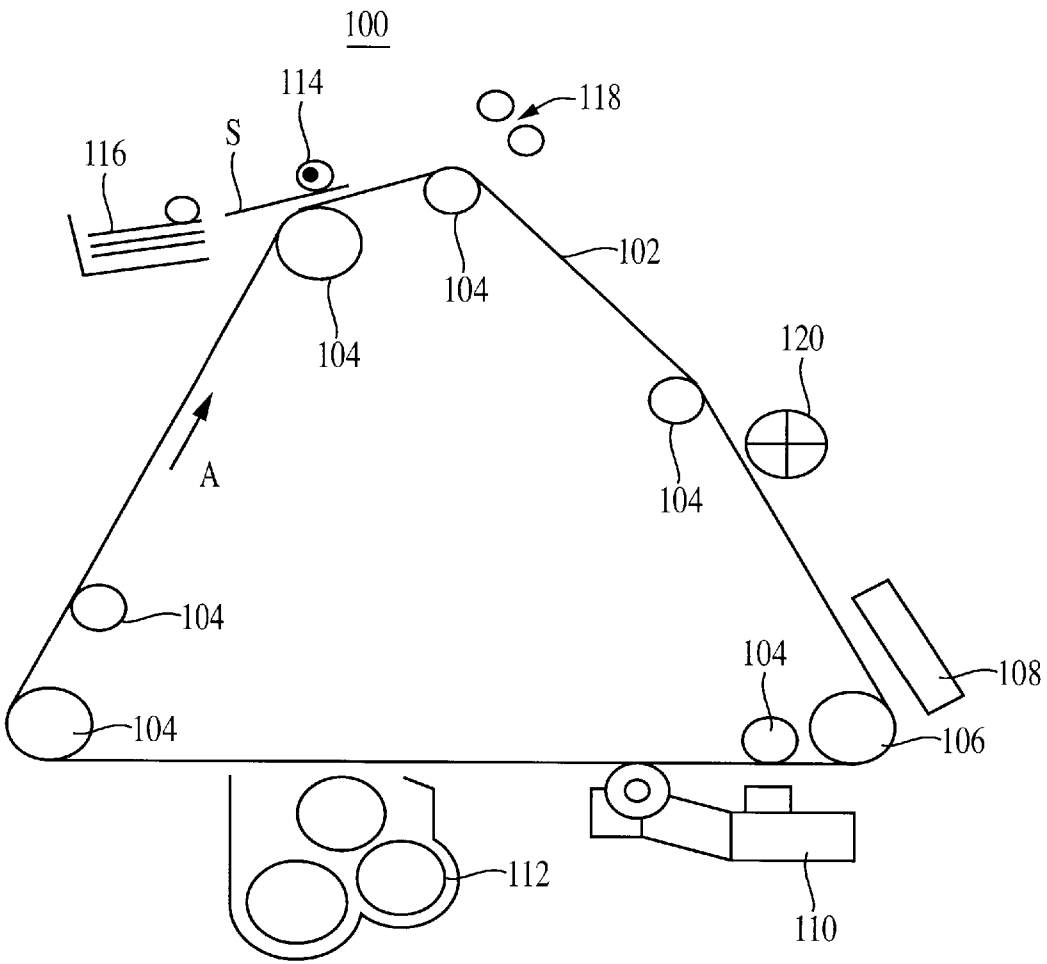
FIG. 1 is a schematic diagram of an image-forming machine having a fuser station.

FIG. 1 is a representative schematic diagram of an image-forming machine 100 having a fuser station 118. The image-forming machine 100 may be a copy machine, a facsimile machine, an electrophotographic image-forming machine, and the like. Along with the fuser station 118, the image-forming machine 100 may include a photoconductor 102, support rollers 104, a motor driven roller 106, a primary charger 108, an exposure machine 110, a toning station 112, a transfer charger 114, a cleaner 120, related equipment, accessories, and the like. The related equipment and accessories may be a feeder 116, a discharge tray (not shown), a logic and control circuit (not shown), a user interface (not shown), an inverter (not shown), a housing (not shown), and the like. The feeder 116 provides sheets of paper or medium. The image-forming machine 100 may have other equipment such as an inserter (not shown) and a finisher (not shown). While particular configurations and arrangements are shown, other configurations and arrangements may be used including those with other and additional components.

In one aspect, the photoconductor 102 is operatively mounted on the support rollers 104 and the motor driven roller 106, which moves the photoconductor 102 in the direction indicated by arrow A. The primary charger 108, the exposure machine 110, the toning station 112, the transfer charger 114, the fuser station 118, and the cleaner 120 are operatively disposed adjacent to the photoconductor 102. The feeder 116 is operatively disposed to provide a sheet S of paper or other medium to the transfer charger 114. Multiple sheets may be process in this manner or the like. The photoconductor 102 has a belt and roller-mounted configuration and may have a drum or other suitable configuration. The housing supports and protects various components of the image-forming machine 100, which may be integrated with or part of the housing.

In use, the primary charger 108 electrostatically charges a frame on the photoconductor 102. The exposure machine 110 optically exposes and forms an electrostatic image on the frame. The toning station 112 applies toner onto the frame. The toner has a charge to adhere to the electrostatic image. The transfer charger 114 transfers the toner from the frame onto a sheet from the feeder 116. The fuser station 118 receives the sheet from the transfer charger 114 and fuses the toner onto the sheet. The sheet exits the image-forming equipment.

Figure 2:
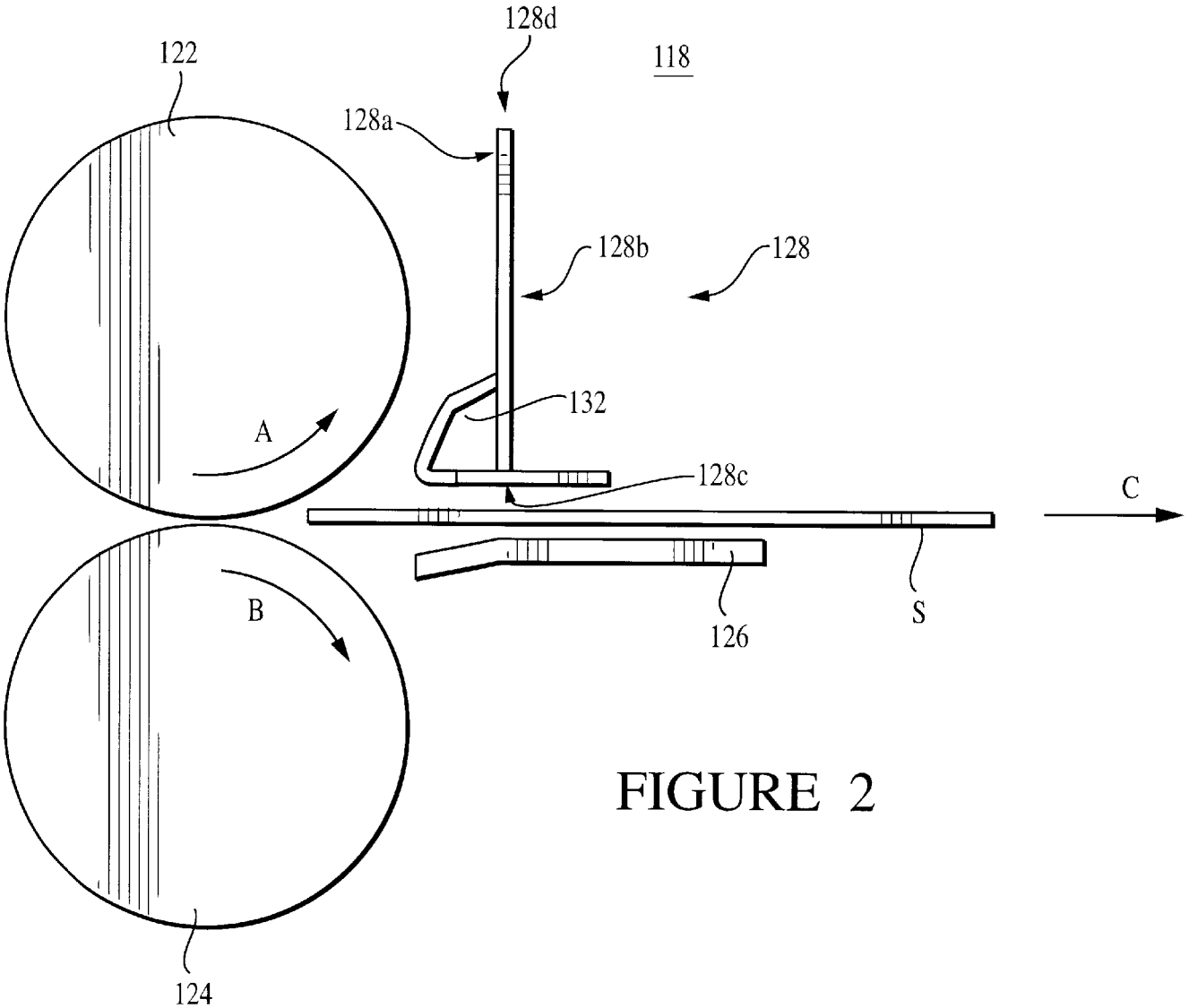
FIG. 2 is a side view of a fuser station for the image-forming machine shown in FIG. 1.

FIG. 2 is a representative side view of the fuser station 118 with a vented skive assembly for the image-forming machine 100 shown in FIG. 1. In one aspect, the fuser station 118 has a pressure roller 122 and a fuser roller 124. The pressure roller 122 and the fuser roller 124 are essentially the same length and are disposed longitudinally to form a nip or pinch region in the area between the rollers. The pressure roller 122 rotates counterclockwise as indicated by the arrow A. The fuser roller 124 rotates clockwise as indicated by arrow B. One or more heater rollers (not shown) heat the fuser roller 124. Other heating devices may heat the fuser roller. The pressure roller 122 also may be heated. The fuser station 118 may have other configurations including other rollers.

The vented skive assembly removes and guides the sheet S away from the pressure and fuser rollers 122 and 124. In one aspect, the vented skive assembly comprises a lower skive assembly 126 and an upper skive assembly 128. The vented skive assembly may comprise other configurations including other upper and lower skive assemblies and may comprise either of the upper and lower skive assemblies individually. The lower and upper skive assemblies 126 and 128 may be interchanged. In this aspect, the upper and lower skive assemblies 126 and 128 have essentially the same length and are positioned in the fuser station 118 essentially longitudinal to the nip region; i.e., essentially longitudinal to the pressure and fuser rollers 122 and 124.

In this aspect, the upper skive assembly 128 has one or more finger portions 132 that project toward the nip region. For orientation purposes, the front 128*a* of the upper skive assembly 128 faces the fuser and pressure rollers 122 and 124. The back 128*b* of the upper skive assembly 128 faces away from the fuser and pressure rolls 122 and 124. The bottom 128*c* of the upper skive assembly 128 faces the lower skive assembly 126 and also faces a sheet as it passes through the upper and lower skive assemblies 128 and 126. The top 128*d* of the upper skive assembly 128 faces away from the lower skive assembly 126 and faces away from a sheet as it passes through the upper and lower skive assemblies 128 and 126.

The fuser station 118 causes toner to fix or adhere to the sheet. In this fixing process, a sheet passes through the pressure and fuser rollers 122 and 124 in a sheet direction indicated by arrow C. For orientation purposes, the sheet S has a leading edge and a trailing edge. The leading edge passes through the nip region first. The trailing edge passes through the nip region last. The sheet also has side edges, which extend from the leading edge to the trailing edge. The sheet may have a rectangular or square shape, in which the side edges extend transversely between the leading and trailing edges.

As the sheet passes through the rollers 122 and 124, the constriction of the nip region presses the toner onto the surface of the sheet. At essentially the same time, the fuser roller 124 transfers heat onto the sheet, causing the toner to fuse to the sheet. The counter-rotation of the rollers 122 and 124 pulls the sheet through the nip region. The leading edge of the sheet is directed into a guide path between the upper and lower skive assemblies 128 and 126. However, the constriction and pressure of the rollers 122 and 124 and the heating of the toner in the nip region may cause the sheet to stick or otherwise attach to the pressure roller 122. If the sheet is stuck or attached to the pressure roller 122, the finger portions 132 catch or engage the leading edge of the sheet as it advances out of the nip region. The finger portions 132 guide or direct the leading edge into the guide path between the upper and lower skive assemblies 128 and 126, thus pulling the sheet away from the pressure roller 122 as the sheet moves out of the nip region.

The fixing process is done at a fixing temperature of about 355° F. However, the process may be done at other temperatures suitable for the toner, the paper or other medium, and the components of the image-forming machine 100. The fixing temperature may remain constant and may vary. In one aspect, the fixing temperature is in the range of about 300° F. through about 400° F. At these temperatures, water evaporates or is driven out of the sheet in the form of water vapor.

Figure 3:
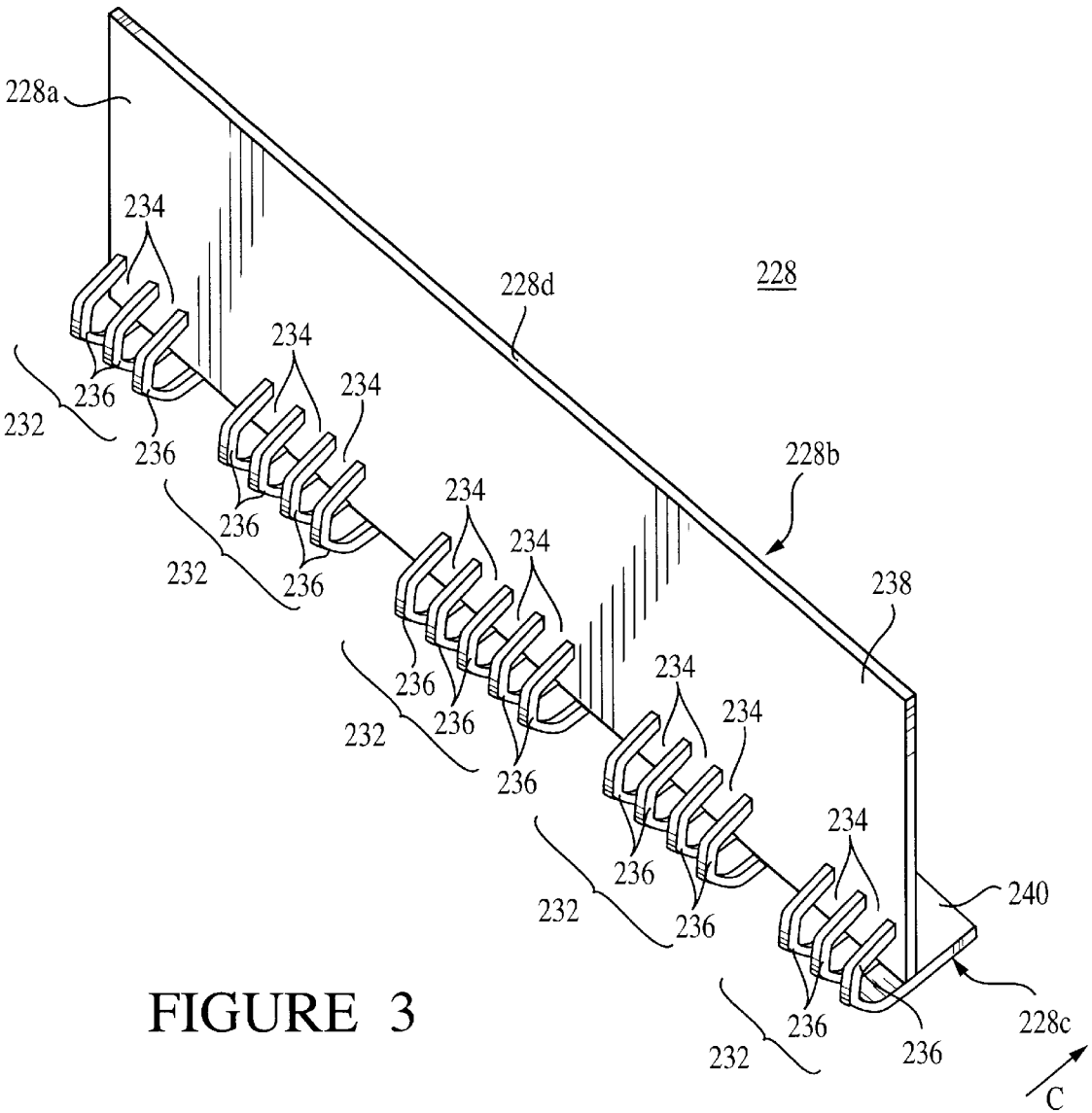
FIG. 3 is a front perspective view of an upper skive assembly for a fuser station in an image-forming machine according to a first embodiment.
Figure 5:
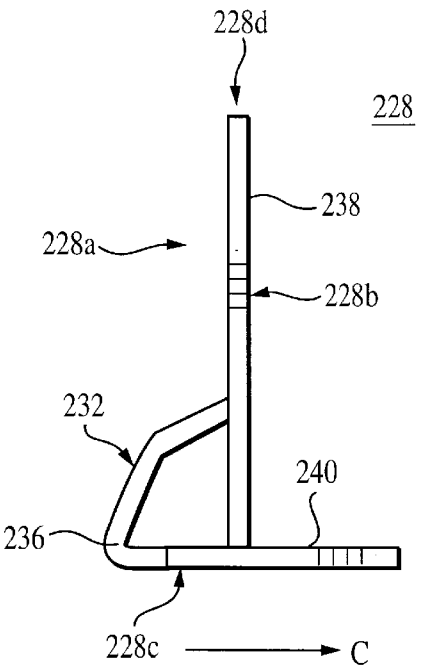
FIG. 5 is a side view of the upper skive assembly shown in FIG. 3.
Figure 4:
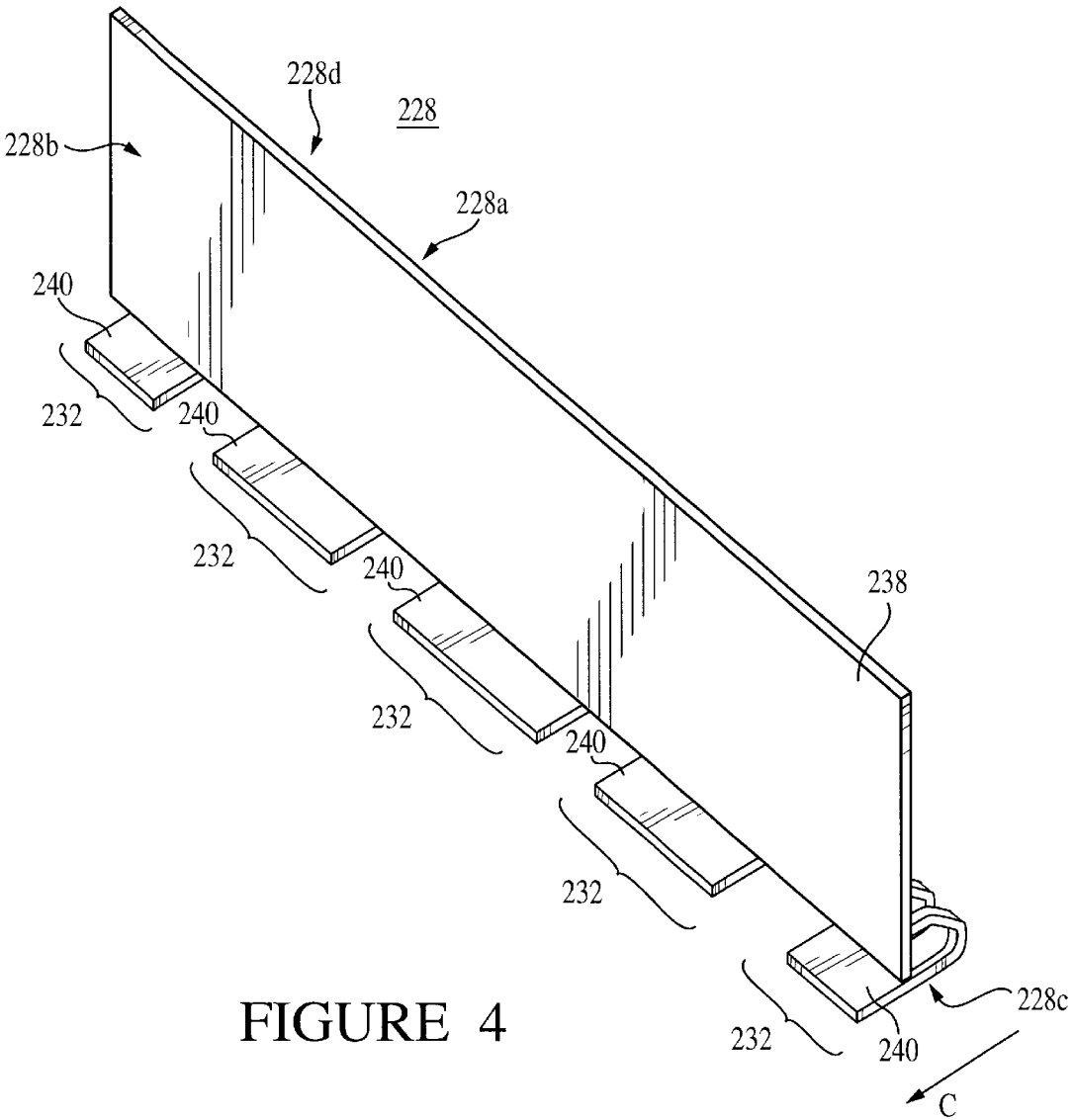
FIG. 4 is a back perspective view of the upper skive assembly shown in FIG. 3.

FIGS. 3–5 are representative views of an upper skive assembly 228 for a fuser station in an image-forming machine according to a first embodiment. In these figures, like reference numerals designate corresponding parts in these figures and in the image-forming machine described in FIGS. 1–2. The corresponding parts have similar functions and may be interchanged. FIG. 3 is a front perspective view of the upper skive assembly 228. FIG. 4 is a back perspective view of the upper skive assembly 228. FIG. 5 is a side view of the upper skive assembly 228. For orientation purposes, the upper skive assembly 228 has a front 228*a,* a back 228*b,* a bottom 228*c,* and a top 228*d.* The arrow C indicates the sheet direction of the sheet S through the fuser station. The upper skive assembly 228 may have other components such as mounting brackets (not shown), support members (not shown), and the like. The upper skive assembly 228 may be made from metal, such as steel, and any other material suitable to provide the structural support and other properties needed for removing sheets from the pressure roller in the fuser station. The upper skive assembly 228 may have other shapes and configurations.

The upper skive assembly 228 may have finger portions 232 connected along the front of a support member 238. There may be five finger portions 232. However, there may be only one finger portion or other multiples of finger portions. The finger portions 232 may be combined to form a single finger assembly (not shown) or groups of finger subassemblies (not shown). Each finger portion 232 has rib sections 236 connected to a base section 240, which may form a single part or multiple parts. The rib sections 236 may connect directly to the support member 238, in which case the base sections 240 would not be necessary. The base sections 240 are configured and connected to the support member 238 such that, when the upper skive assembly 228 is mounted on a fuser station, the base sections 240 form a guide path with the lower skive assembly (not shown) for a sheet to follow when it exits the pressure and fuser rollers. In one aspect, each base section 240 has a plate-like structure, which may be planar, angular, circular, or some other configuration. The base sections 240 may be connected to the support member 238 at an angle or curved position to the guide path. The angle may be chosen to correspond with a desired direction of the sheet as it exits the fuser and pressure rollers.

The finger portions 232 are configured and connected to the support member 238 such that, when the upper skive assembly 228 is mounted on a fuser station, the rib sections 236 project toward the nip region of the fuser and pressure rollers. If a sheet sticks to the pressure roller, the rib sections 236 are positioned to catch the leading edge of the sheet as it advances out of the nip region. The sheet then pulls away from the pressure roller as the sheet moves out of the nip region. The rib sections 236 guide the leading edge of the sheet toward the base sections 240 and onto the guide path between the upper and lower skive assemblies.

In this aspect, the rib sections 236 extend from the base sections 240 passing the front 228*a* of the upper skive assembly 228 and projecting toward the nip region. The rib sections 236 turn back toward and connect to the support member 238 at the front 228*a* of the upper skive assembly 228. The rib sections 236 may connect elsewhere on the support member 238. In this aspect, the rib sections 236 have an angular shape. However, the rib sections 236 may have triangular, curved, multi-facetted, combination, and other configurations. The cross-section of the rib sections 236 may be rectangular, angular, square, circular, and other configurations.

The rib sections 236 form slots 234 in the finger portions 232. The slots 234 are openings in which air may flow through the upper skive assembly 228. In one aspect, the slots 234 are configured to provide an airflow pattern to reduce condensation on the upper skive assembly 228. "Reduce condensation" includes partially or completely preventing or eliminating the condensation of water vapor on the skive assembly. The slots 234 may reduce condensation across the entire skive assembly or in a particular area or areas of the skive assembly. There may be only one slot to reduce condensation on one part of the skive assembly. The air may have various flow patterns. The airflow may be provided by the natural heat convection from the fuser roller, by the environmental system (not shown) for the image-forming machine, a combination, and the like. There may be two to four slots 234 on each finger portion 232. However, there may be only one slot 234 or other multiples of slots 234 on each finger portion 232. There may be one finger portion 232 essentially spanning the length of the support member 238, where the one finger portion 232 has a plurality of slots 234.

In one aspect, the slots 234 are formed vertically from the bottom 228*c* and are essentially aligned with the sheet direction. The slots 234 follow the rib sections 236 to the connection of the rib sections 236 with the support member 238 at the front 228*a*. The slots 234 may be formed horizontally or at an angle to the sheet direction. The slots also may have a spiral shape or another configuration. The slots 234 may be groups of holes (not shown) or other openings that form perforated sections (not shown) in the finger portions 232. One or more of the slots 234 may extend into or through one or more of the base sections 240. The slots 234 may be formed into groups of slots, where one group has one configuration and another group has another configuration. A first group of slots may be aligned or be aligned at an angle to the sheet direction. A second group of slots may be aligned at a different angle to the sheet direction.

Each of the openings created by the slots 234 has an open area along the surface of the finger portions 232. The open areas may be combined to provide an total open area for the upper skive assembly 228. Similarly, each of the rib sections 236 forms a closed area along the surface of the finger portions 232. The closed areas may be combined to provide an total closed area for the upper skive assembly 228. In one aspect, the ratio of the total open area of the slots 234 to the total closed area of the rib sections 236 is in the range of about 1:1 through about 6:1. The ratio of the total open area of the slots 234 to the total closed area of the rib sections 236 may be greater than about 6:1, in which case the rib sections 236 may have a more wire-like configuration. The ratio of the total open area of the slots 234 to the total closed area of the rib sections 236 may be less than about 1:1 as long as there is suitable airflow or an airflow pattern to reduce condensation on the upper skive assembly 228. Increasing the throughput of the environmental system may improve the airflow. The open area of each slot 234 may be the same or may vary. The total open area may be evenly distributed and may vary across one or all of the finger portions 232 and across the upper skive assembly 228. One finger portion may have narrow slots (not shown). Another finger portion may have wide slots (not shown). Yet another finger portion may have a combination of narrow slots and wide slots (not shown).

In one aspect, the support member 238 is configured and connected to the finger portions 232 such that, when the upper skive assembly 228 is mounted on a fuser station, the rib sections 236 and the base sections 240 are positioned as previously discussed. The support member 238 may be disposed essentially parallel to the nip region between the pressure and fuser rollers in a fuser station. The support member 238 may have a planar, rectangular shape. However, the support member 238 may have an angled, curved, another shape, a combination, and the like. The support member 238 may have any suitable thickness and dimensions and may be part of or form another part in the image-forming machine. The rib sections 236 may be connected to the front of the support member 238 and may connect directly to the bottom of the support member 238. The connections with the rib sections 236 may form an essentially straight line, a curved line, another type of line, a combination of lines, and may not form any line. Also, the base section 240 may be connected along the bottom of the support member 238. The connections with the base sections 240 may form an essentially straight line, a curved line, another type of line, a combination of lines, and may not form any line. One or more of the rib sections 236 and one or more of the base sections 240 may have the same connection with the support member 238.

FIGS. 6–12 are representative views of an upper skive assembly 628 for a fuser station in an image-forming machine according to a second embodiment. In these figures, like reference numerals designate corresponding parts in these figures, the first embodiment described in FIGS. 3–5, and the image-forming machine described in FIGS. 1–2. The corresponding parts have similar functions and may be interchanged.

Figure 6:
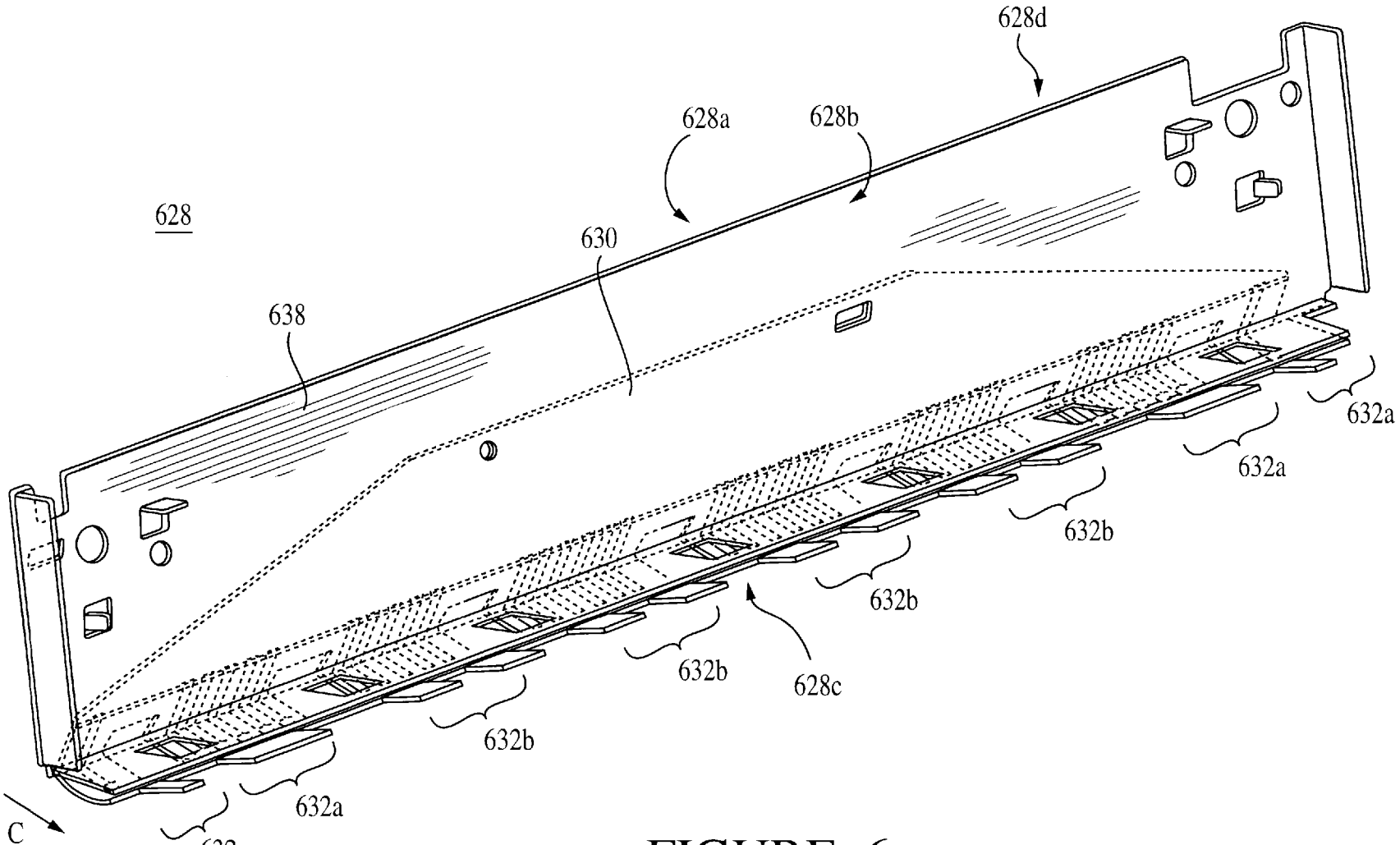
FIG. 6 is a back perspective view of an upper skive assembly for a fuser station in an image-forming machine according to a second embodiment.
Figure 7:
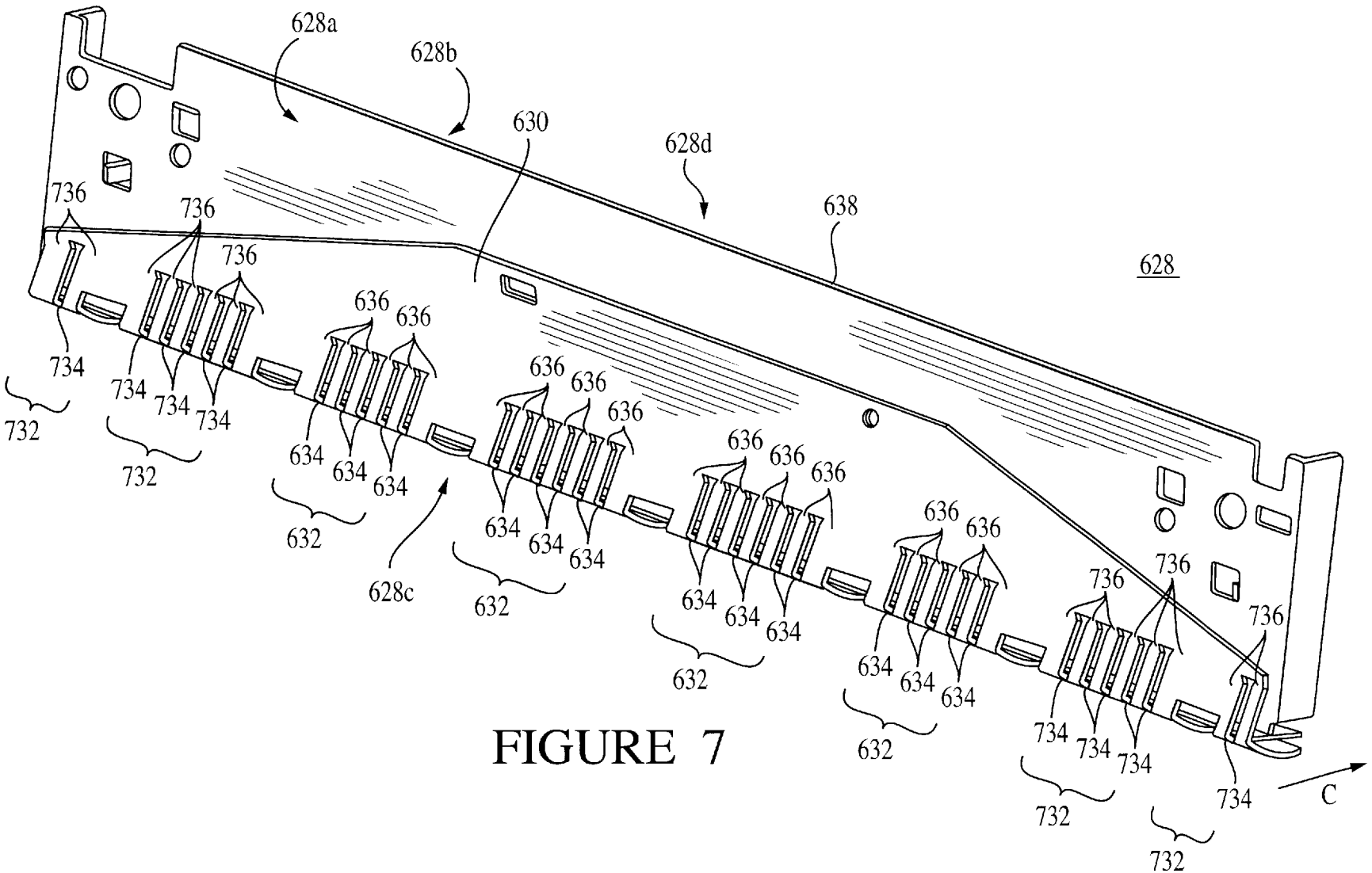
FIG. 7 is a front perspective view of the upper skive assembly shown in FIG. 6.
Figure 8:
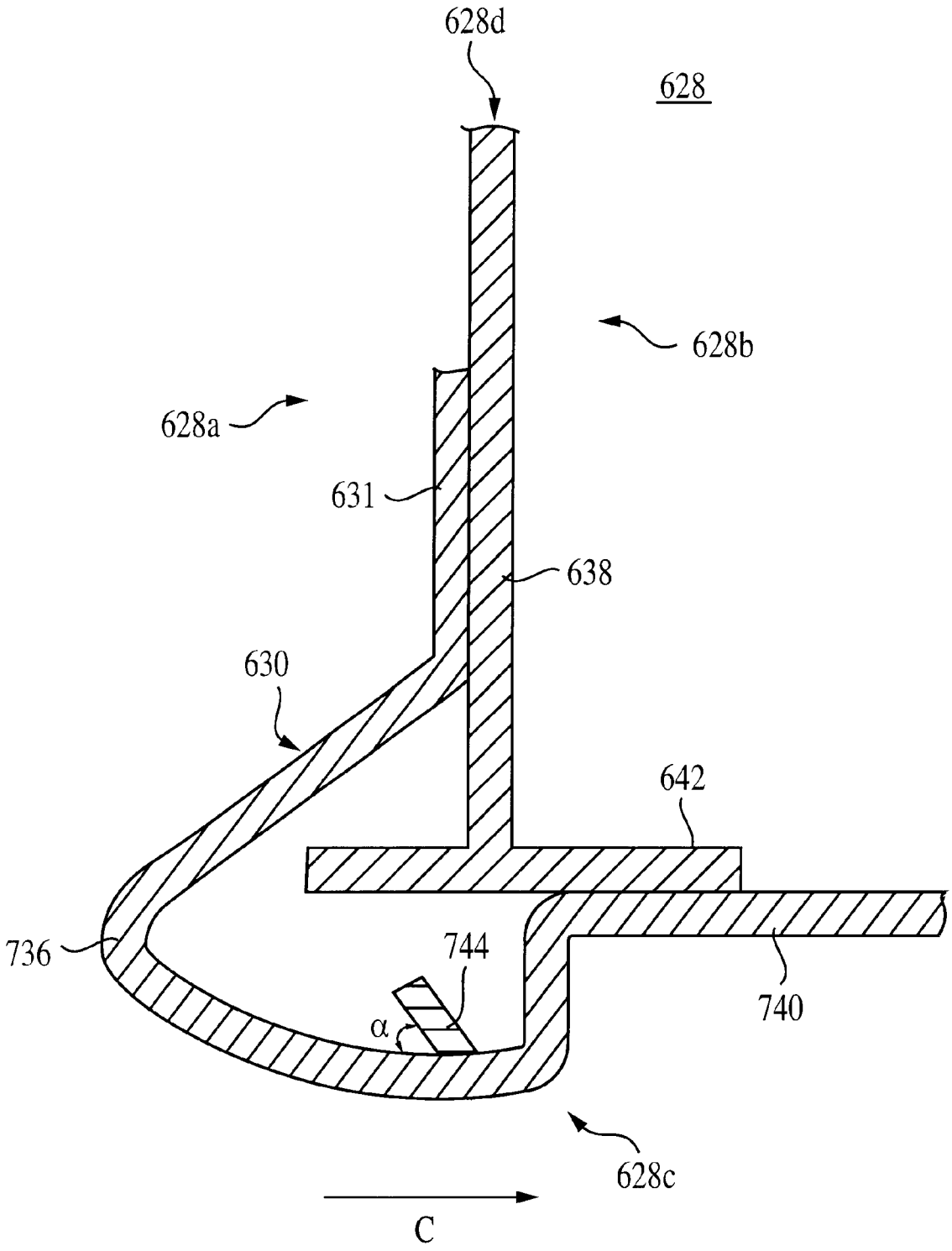
FIG. 8 is a side view of the upper skive assembly shown in FIG. 6.
Figure 9:
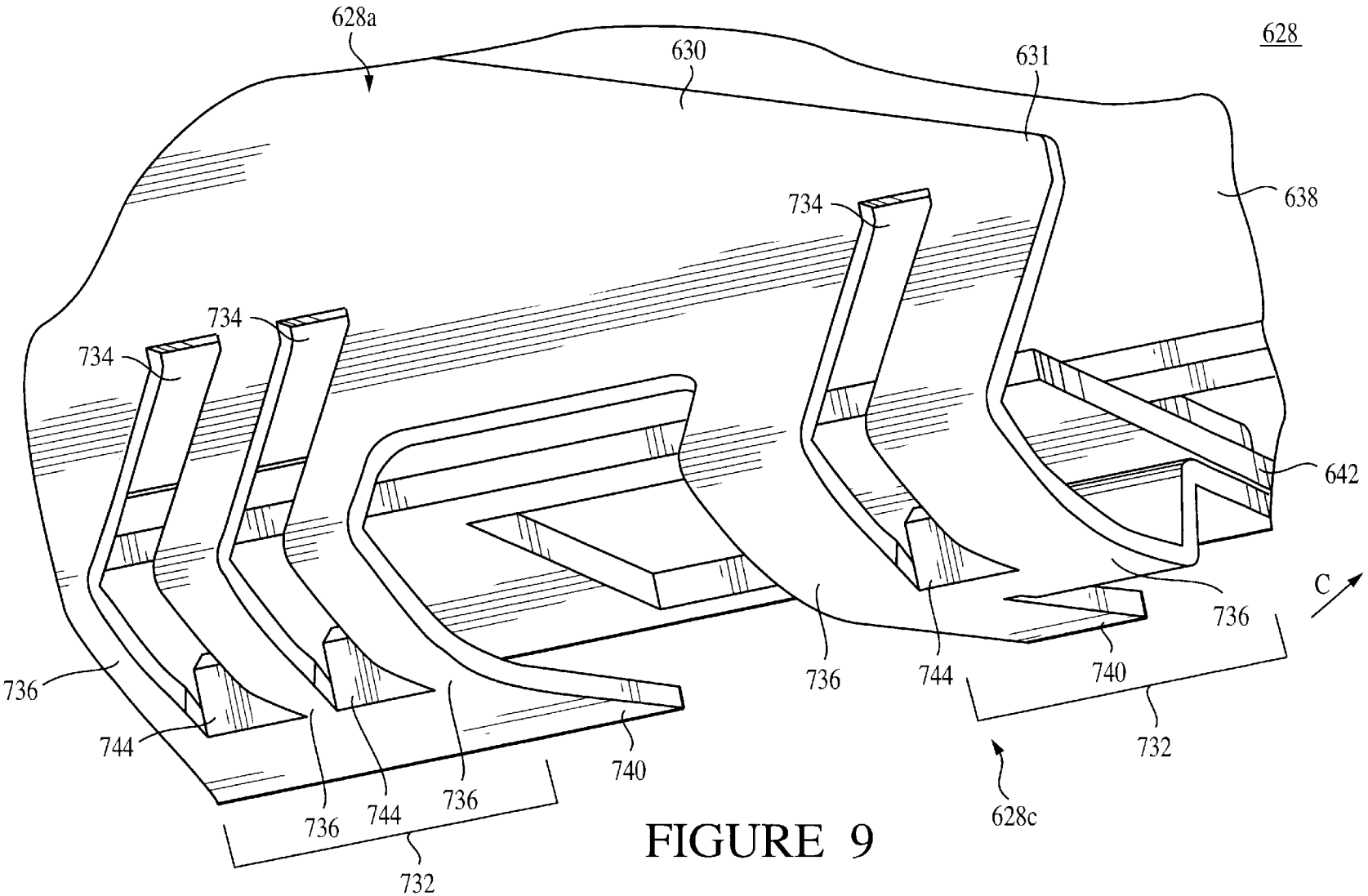
FIG. 9 is a first close-up bottom perspective view of the upper skive assembly shown in FIG. 6.
Figure 10:
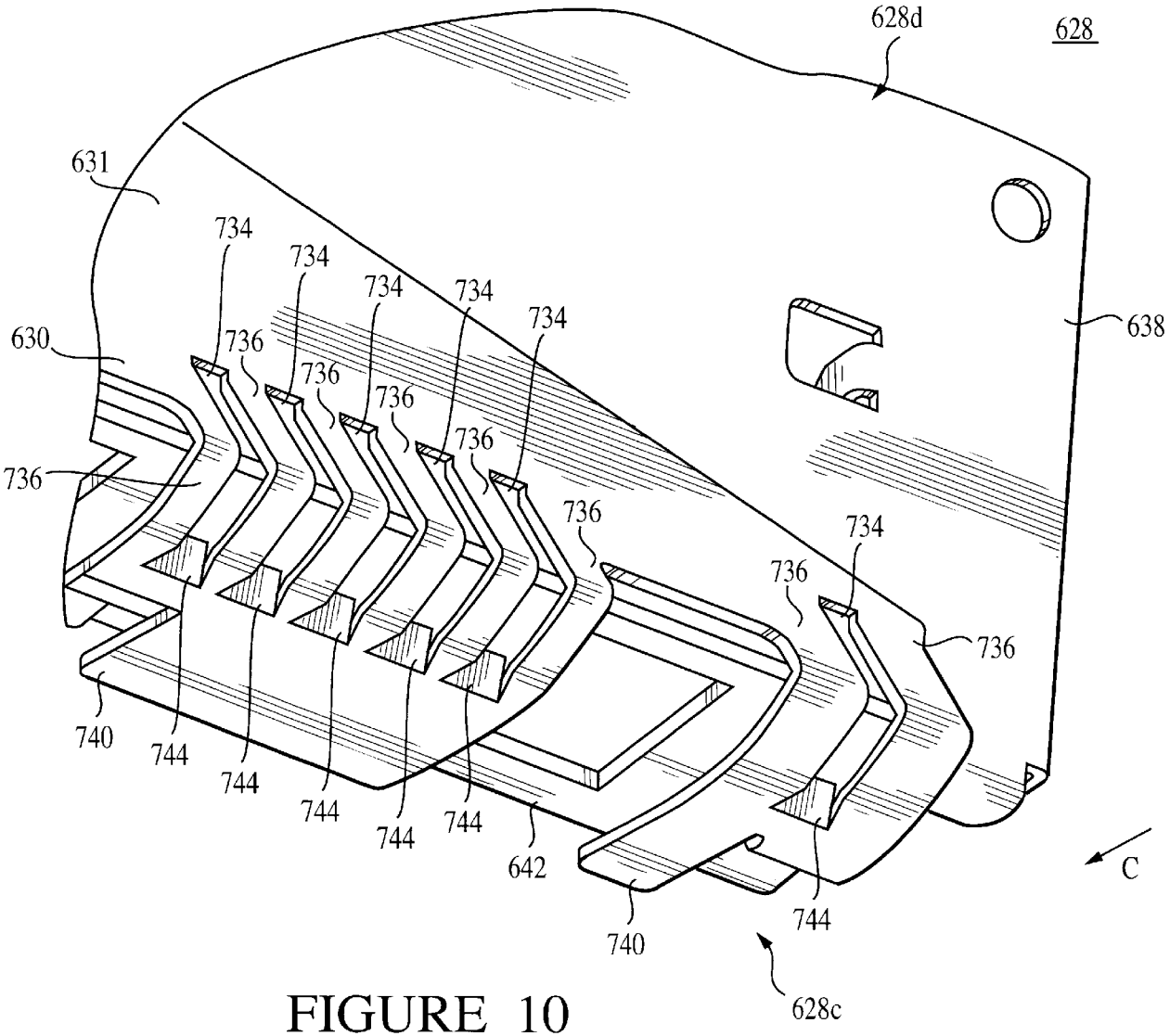
FIG. 10 is a second close-up bottom perspective view of the upper skive assembly shown in FIG. 6.
Figure 11:
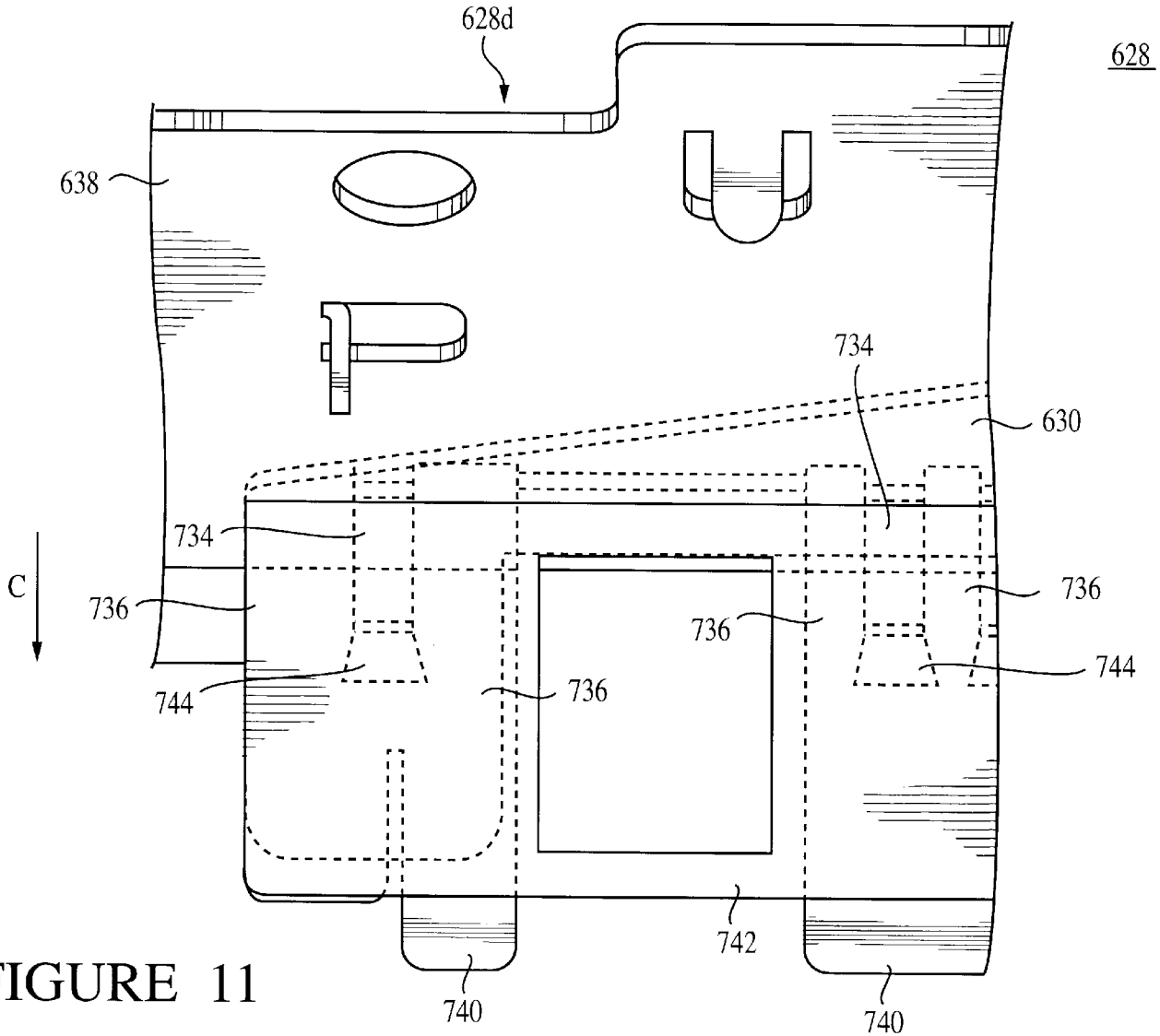
FIG. 11 is a close-up top perspective view of the upper skive assembly shown in FIG. 6.
Figure 12B:
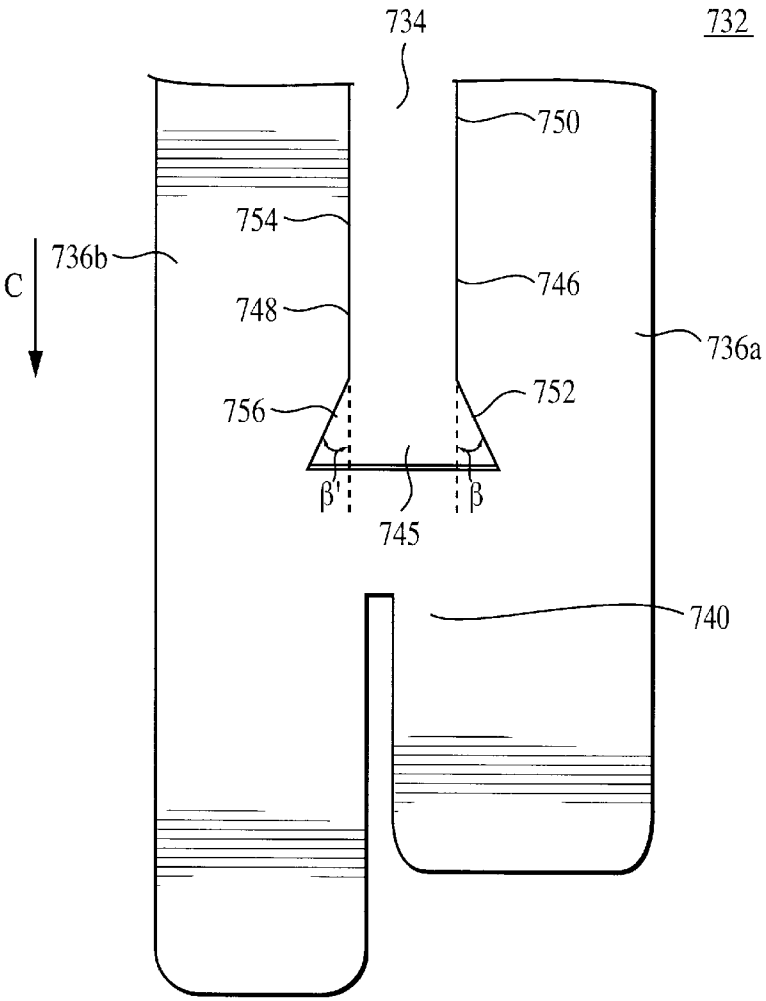
Figure 12A:
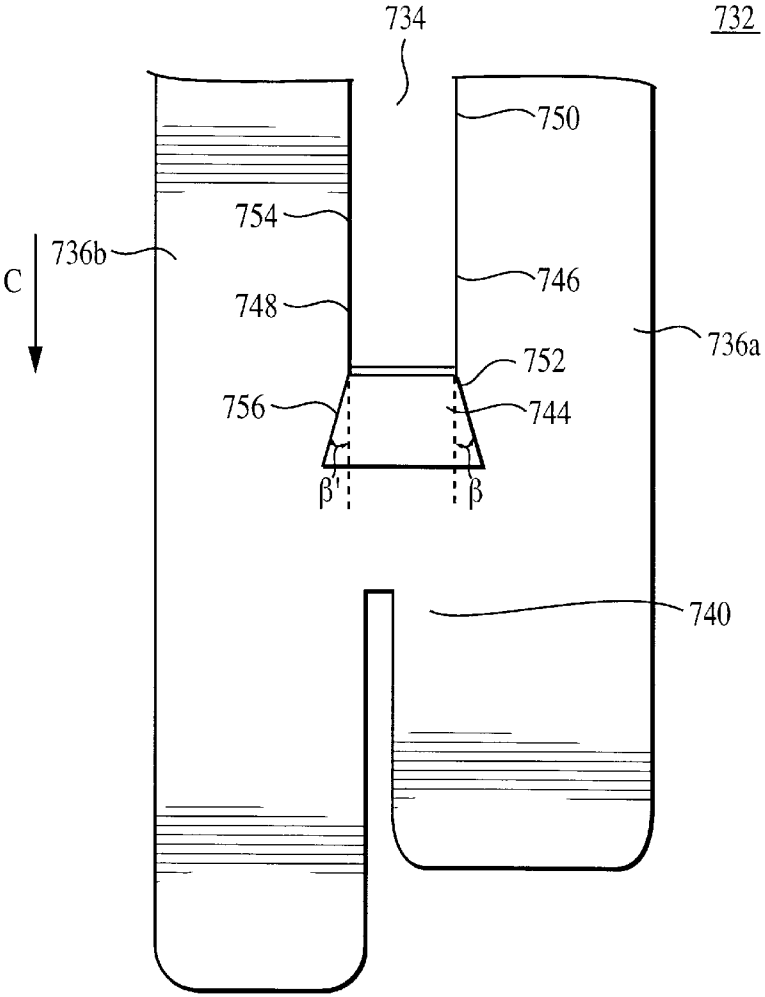
Figure 13:
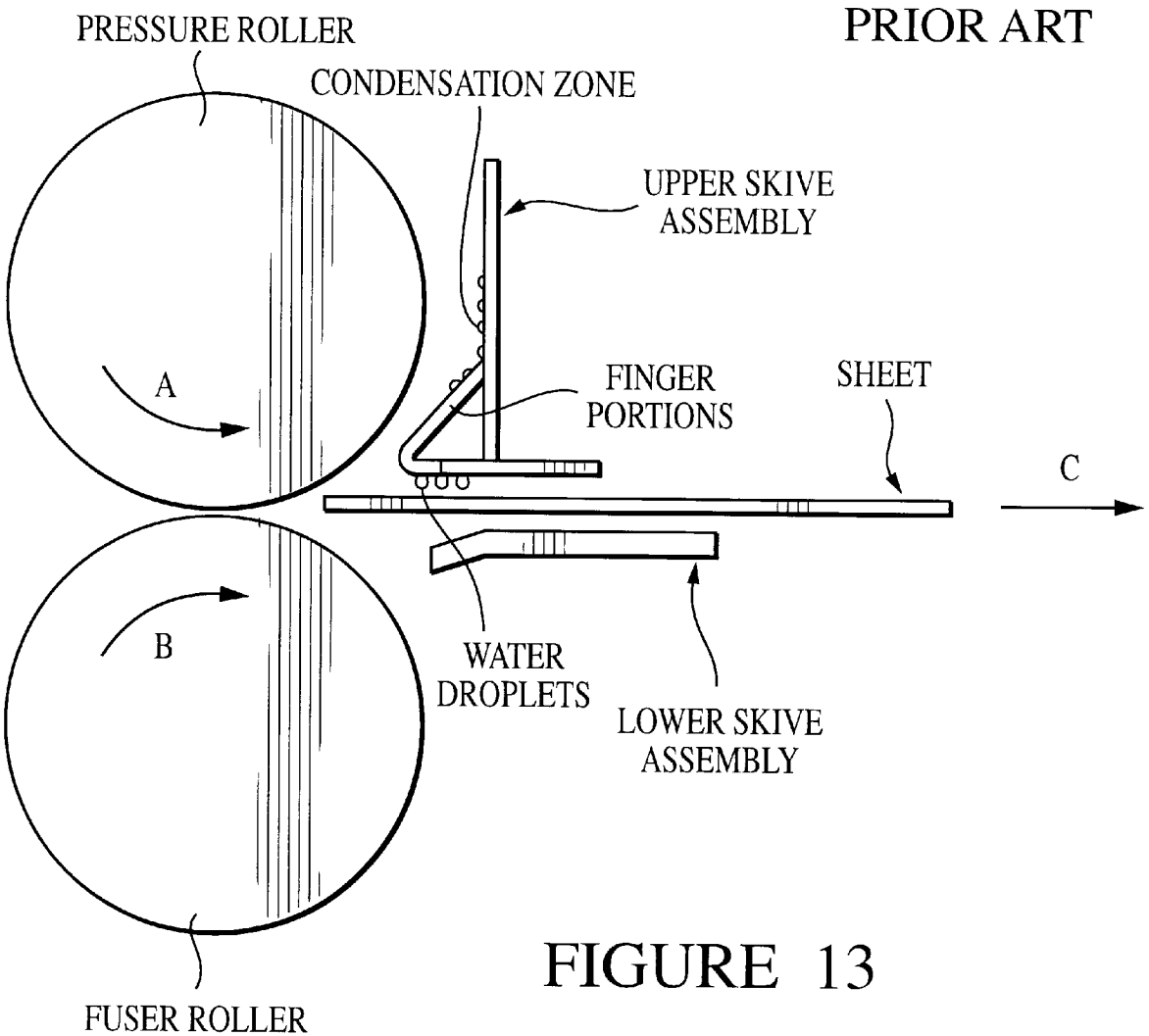
FIG. 13 is a side view of a fuser station for an image-forming machine according to the prior art.
Figure 14:
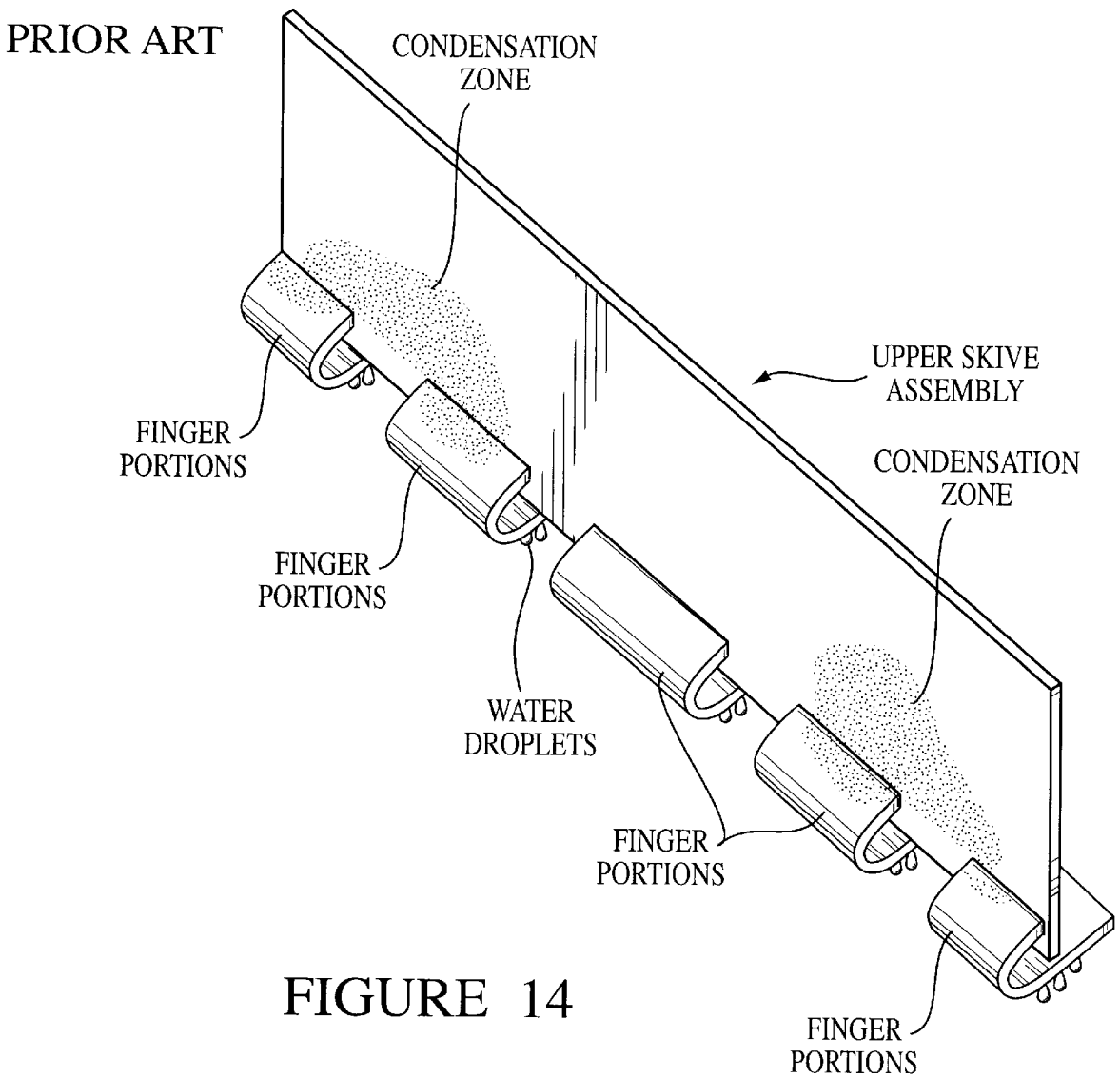
FIG. 14 is a front perspective view of an upper skive assembly for a fuser station in an image-forming machine according to the prior art.

FIG. 6 is a back perspective view of the upper skive assembly 628. FIG. 7 is a front perspective view of the upper skive assembly 628. FIG. 8 is a side edge view of the upper skive assembly 628. FIG. 9 is a close-up bottom perspective view from one side edge of the upper skive assembly 628. FIG. 10 is a close-up bottom perspective view from the other side edge of the upper skive assembly 628. FIG. 11 is a close-up top view of the upper skive assembly 628. FIG. 12 shows close-up bottom views of a finger portion 732 of the upper skive assembly 628. FIG. 12A includes a tab section 744. FIG. 12B does not include the tab section.

For orientation purposes, the upper skive assembly 628 has a front 628*a*, a back 628*b*, a bottom 628*c*, and a top 628*d*. The arrow C indicates a sheet direction of a sheet through the fuser station. The upper skive assembly 628 may have other components. The upper skive assembly 628 may be made from metal such as steel and may be made of any suitable material. The upper skive assembly 628 may have other shapes and configurations.

The upper skive assembly 628 may have a finger assembly 630, which includes an upper section 631 and finger portions 632 and 732. The finger portions 632 and 732 have rib sections 636 and 736 and base sections 640 and 740. The finger assembly 630 may be made from a single part. The finger assembly 630 is configured and connected to the support member 638 such that, when the upper skive assembly 628 is mounted on a fuser station, the rib sections 636 project toward the nip region of the fuser and pressure rollers. In this position, the rib sections 636 and 736 catch or engage the leading edge of a sheet as it advances out of the nip region. The sheet pulls away from the pressure roller as the sheet moves out of the nip region. The rib sections 636 and 736 guide or direct the leading edge toward the base sections 640 and 740 and onto the guide path between the upper and lower skive assemblies.

The finger portions 632 and 732 are arranged along the front of the support member 638. The finger portions 632 and 732 are connected to the upper section 631, which connects to the support member 638. The finger portions 632 and 732 may be connected separately to the support member 638 and may be combined into multiple subassemblies (not shown) connected to the support member 638. While this embodiment shows eight finger portions 632 and 732, there may be only one finger portion or other multiples of finger portions.

Each finger portion 632 and 732 has multiple rib sections 636 and 736 connected to a base section 640 and 740. The rib sections 636 and 736 and the base section 640 and 740 may form a single part or multiple parts. The base sections 640 and 740 are configured and connected to the support member 638 such that, when the upper skive assembly 628 is mounted on a fuser station, the base sections 640 and 740 form a guide path with the lower skive assembly (not shown) for the sheet to follow when it exits the pressure and fuser rollers. The rib sections 636 and 736 may connect directly to the bottom of the support member 638 with the base sections 640 and 740. In one aspect, each base section 640 and 740 has a plate-like structure, which may be planar, angular, circular, or some other configuration. One or more of the base sections 640 and 740 may form a tail or an otherwise uneven portion along the back 628*b* of the upper skive assembly 628. The tail portion may curve or angle away from the guide path. The base sections 640 and 740 may be connected to the support member 638 at an angle or curved position to the guide path. The angle or curve may be chosen to correspond with a desired direction of the sheet as it exits the fuser and pressure rollers.

In one aspect, the rib sections 636 and 736 extend from the base sections 640 and 740 passing the front 628*a* of the upper skive assembly 628 and project toward the nip region. The rib sections 636 and 736 then turn back toward the support member 638 at the front of the upper skive assembly 628. The rib sections 636 and 736 connect to or form the upper section 631, which connects to the front of the support member 638. The upper section 631 may connect elsewhere on the support member 638. The rib sections 636 and 736 may connect directly to the support member 638 without the upper section 631. The rib sections 636 and 736 may have a triangular shape and may be angled, curved, multi-facetted, a combination, and other configurations. The cross-section of the rib sections 636 and 736 may be square, angular, and the like.

The rib sections 636 and 736 form slots 634 and 734 in the finger portions 632 and 732. The slots 634 and 734 are openings in which air may flow through the upper skive assembly. The airflow may have various patterns as previously discussed. The airflow may be provided by the natural heat convection from the fuser roller, by the environmental system (not shown) for the image-forming machine, a combination, and the like. There may be one to six slots 634 and 734 on each finger portion 632 and 732. However, each finger portion 632 and 732 may have one slot 634 and 732 or other multiples of slots 634 and 734. There may be one and other multiples of the finger portions 632 and 732. There may be one finger portion 632 and 732 essentially spanning the length of the support member 638, where the one finger portion 632 and 732 has a plurality of slots 634 and 734.

The slots 634 and 734 are configured to provide an airflow pattern to reduce condensation on the upper skive assembly 628 as previously discussed. The slots 634 and 734 may be formed vertically from the bottom of the upper skive assembly 628 and are aligned essentially with the sheet direction C. The slots 634 and 734 follow the rib sections 636 and 736 to the connection with the upper section 631. The slots 634 and 734 may be formed horizontal, angular, and with other configurations in relation to the sheet direction C. The slots 634 and 734 may be groups of holes (not shown) or other openings that form perforated sections (not shown) in the finger portions 632. One or more of the slots may extend into or through one or more of the base sections 640 and 740. One or-more of the slots may extend into and through the upper section 631.

Each of the openings created by the slots 634 and 734 has an open area along the surface of the finger portions 632 and 732. The open areas may be combined to provide an total open area for the upper skive assembly 628. Similarly, each of the rib sections 636 and 736 forms a closed area along the surface of the finger portions 632 and 732. The closed areas may be combined to provide an total closed area for the upper skive assembly 628. In one aspect, the ratio of the total open area of the slots 634 and 734 to the total closed area of the rib sections 636 and 736 is in the range of about 1:1 through about 6:1. The ratio of the total open area of the slots 634 and 734 to the total closed area of the rib sections 636 and 736 may be greater than about 6:1, in which case the rib sections 636 and 736 may have a more wire-like configuration. The ratio of the total open area of the slots 634 and 734 to the total closed area of the rib sections 636 and 736 may be less than about 1:1 as long as there is suitable airflow or an airflow pattern to reduce condensation on the upper skive assembly 228. Increasing the throughput of the environmental system may improve the airflow. The open area of each slot 634 and 734 may be the same or may vary. The total open area may be evenly distributed and may vary across one or all of the finger portions 632 and 732 and across the upper skive assembly 628. One finger portion may have narrow slots (not shown). Another finger portion may have wide slots (not shown). Yet another finger portion may have a combination of narrow slots and wide slots (not shown).

The support member 638 is configured and connected to the finger assembly 630 such that, when the upper skive assembly 628 is mounted on a fuser station, the rib sections 636 and 736 and the base sections 640 and 740 are positioned as previously discussed. The support member 638 may be disposed essentially parallel to the nip region between the pressure and fuser rollers in a fuser station. The support member 638 may have a planar, rectangular shape. However, the support member 638 may have an angled, curved, another shape, a combination, and the like. The support member 638 may have any suitable thickness and dimensions and may be part of or form another part in the image-forming machine. The upper section 631 of the finger assembly 630 may connect to the front of the support member 638.

The base sections 640 and 740 may connect along the bottom of the support member 638. In one aspect, the support member 638 has a ledge portion 642. The ledge portion 642 horizontally connects to one or more of the base sections 640 and 740. The support member 638 may be connected to one or more of the base sections 640 and 740 without the ledge portion 642, and by other means. The connections with the base sections 640 and 740 may form an essentially straight line, a curved line, another type of line, a combination of lines, and may not form any line. The support member 638 also may connect with one or more of the rib sections 636 and 736 on the bottom 628*c* of the upper skive assembly 628 at or near the connection of the support member 638 with one or more of the base sections 640 and 736.

In one aspect, the finger portions 732 may have an insert prevention device operatively disposed in each of the slots 734. The finger portions 632 do not have the insert prevention device disposed in each of the slots 634. However, any or all of the slots 634 each may have the insert prevention device. There may be different configurations of finger portions 632 and 732 that have the insert prevention device in one or more of the slots. One or more of the slots 634 and 734 may have the insert prevent device.

The image-forming machine may be designed to center align the sheets with the upper skive assembly 638. When sheets are center aligned, the center of each sheet passes along the center of the upper skive assembly. Accordingly, the position of the sheet side edges along the upper skive assembly 628 varies with the sheet size. In one aspect, the finger portions 732 extend to cover an area on each side edge of the upper skive assembly corresponding to the edge locations of the expected or planned sheet sizes used in the image-forming machine. The number of finger portions 732 on each side edge of the upper skive assembly 628 may be the same and may vary. If smaller sheets are used, there may be more finger portions 732.

The sheets may be edge aligned—the same side edge of each sheet passes along an alignment edge on the upper skive assembly 628. The position of the side edge along the alignment edge is essentially the same regardless of the sheet size. However, the position of the other side edge along the upper skive assembly varies with the sheet size. The number of finger portions 732 on each side edge of the upper skive assembly 628 may be different. There may be one or two finger portions 732 along the alignment edge with more finger portions 732 along the side edge opposite the alignment edge. The additional finger portions 732 would accommodate sheets of different dimensions. In an upper skive assembly with eight finger portions 632 and 732; there may be two finger portions 732 on the alignment edge side edge, followed by two finger portions 632, followed by four finger portions 732 on the other side edge.

The insert prevention device prevents and corrects a sheet stubbing a slot as the sheet passes the upper skive assembly 628. "Stubbing" includes any manner of the sheet entering, engaging, jamming, and catching on or in a slot, especially on a rib or base section, and the like. If the side edge of a sheet enters a slot, the leading edge of the sheet may hit the base section or other part as the sheet passes across the upper skive assembly 628. The stubbing may cause the sheet to fold, bend, become entangled, tear, and the like. The insert prevention device may reduce or eliminate the ability of the side edge to enter a slot. If a side edge should stub a slot, the insert prevention device may remove or otherwise disengage the sheet from a slot and any adjacent rib and base sections.

In one aspect, the insert prevention device includes a tab section 744 and an angled slot portion 745 (see FIGS. 8, 12A, and 12B). The insert prevention device may include one of the tab section 744 and the angled slot portion 745. The insert prevention device may include other configurations suitable to prevent and correct for stubbing. The insertion prevention device may be integrally formed with the base section 740 and at least one of the rib sections 736 from the same piece. "Integrally formed" includes cutting, bending, and shaping a single piece such as a metal plate or other suitably shaped material.

In this aspect, the tab section 744 extends from the base section 740 into the slot 734. The connection of the tab section 744 with the base section 740 preferably is closer to the bottom and back of the upper skive assembly 628. The portion of the tab section 744 extending into the slot 734 preferably is closer to the top and front of the upper skive assembly. The tab section 744 may be formed from at least one of the base section 740 and one or more rib sections 736. The tab section 744 may be cutout except for the connection with the base section 740. In one aspect, the tab section 744 forms a smooth transition or connection with the base section 740. The tab section 744 may be essentially the same size or slightly smaller than the angled slot portion 745. The exterior of the tab section 744 may be the same or have a similar configuration as the angled slot portion 745. The base section 740, tab section 744, and rib sections 736 may be the same piece or part of the same piece such as the finger assembly 630.

In this aspect, the tab section 744 forms an angle $\alpha$ with the base section 740 or the bottom 628*c* of the upper skive assembly 628 (see FIG. 8). The tab section 744 may form the angle $\alpha$ with on or a portion of a rib section or another part that is essentially parallel to the sheet direction. The angle $\alpha$ may be selected to guide the leading edge of a sheet out of the slot 734. In one aspect, the angle $\alpha$ is greater than about five degrees. In another aspect, the angle $\alpha$ is the range of about 15 degrees through about 45 degrees. In yet another aspect, the angle $\alpha$ is about 30 degrees.

The angled slot portion 745 is formed by a first slot edge 746 of a first rib section 736*a* and a second slot edge 748 of a rib section 736*b* (see FIGS. 12A and 12B). The first slot edge 746 has a first straight segment 750 and a first angled segment 752. The second slot edge 748 has a second straight segment 754 and a second angled segment 756. In one aspect, the first and second straight segments 750 and 754 are essentially parallel to the sheet direction C. However, the first and second straight segments 750 and 754 may be at an angle to the sheet direction C and at an angle to each other. In this aspect, the first and second angled segments 752 and 756 slant toward the rib sections 736*a* and 736*b*, respectively. However, one or both of the first and second angled segments 752 and 756 may slant toward the slot 734. The first and second angled segments 752 and 756 may be parallel. Both slot edges 746 and 748 may not have any straight segments 750 and 754. One slot edge may have straight and angled segments while the other slot edge has one of straight and angled segments.

The angled segments 752 and 756 form angles $\beta$ and $\beta'$ with the straight segments 750 and 754, respectively. One or both of the angle segments 752 and 756 may include part or all of the edge sections 746 and 748, respectively. In which case there would not be one or both of the straight segments 750 and 754. The angles $\beta$ and $\beta'$ may be the same and may be different for one or more slots 734. One or both of the angles $\beta$ and $\beta'$ may be configured to prevent a sheet from stubbing. In one aspect, one or both of the angles $\beta$ and $\beta'$ is greater than about two degrees. In another aspect, one or both of the angles $\beta$ and $\beta'$ is in the range of about 5 degrees through about 20 degrees. In yet another aspect, one or both of the angles $\beta$ and $\beta'$ is about 13 degrees.

In one aspect, the tab section 744 and the angled slot portion 745 prevent, reduce, and correct, individually and in combination, the stubbing of a sheet in the slot 734. As the sheet passes across the upper skive assembly 628, the side edges may pass across one or more of the angled slot portions 745. Because the angled slot portions 745 crosses the side edges at the angles $\beta$ and $\beta'$, it is very difficult if not impossible for the sheet to enter the angled slot portions 745. If a side edge enters a slot 745, the portion of the leading edge in the slot 745 engages the tab section 744 as the sheet passes across the upper skive assembly 628. The tab section 744 essentially guides the leading edge out of the slot 745 and back into the guide path between the upper and lower skive assemblies.

Various embodiments of the invention have been described and illustrated. However, the description and illustrations are by way of example only. Many more embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. A skive assembly for a fuser station in an image-forming machine, comprising:

a support member; and a plurality of rib sections connected to the support member, the plurality of rib sections forming at least one slot, where the at least one slot is configured to provide an airflow pattern to reduce condensation on the skive assembly, where the at least one slot comprises at least one first slot and at least one second slot, the at least one first slot at an angle to the at least one second slot.

2. A skive assembly for a fuser station in an image-forming machine, comprising:

a support member; and a plurality of rib sections connected to the support member, the plurality of rib sections forming at least one slot, where the at least one slot is configured to provide an airflow pattern to reduce condensation on the skive assembly, where the at least one slot comprises at least one first slot and at least one second slot, and where the at least one first slot is larger than the at least one second slot.

3. A skive assembly for a fuser station in an image-forming machine, comprising:

a support member; and a plurality of rib sections connected to the support member, the plurality of rib sections forming at least one slot, where the at least one slot is configured to provide an airflow pattern to reduce condensation on the skive assembly, further comprising an insert prevention device disposed in the at least on slot.

4. A skive assembly according to claim 3, where the at least one slot comprises at least one first slot and at least one second slot, where the insert prevention device is disposed in the at least one first slot.

5. A skive assembly according to claim 3, where the insert prevention device is at least one of a tab section and an angled slot portion.

6. A skive assembly according to claim 5, where the tab section and the angled slot portion are integrally formed from one piece comprising the base section and at least one rib section.

7. A skive assembly according to claim 5, where the tab section is disposed to guide an edge of a sheet out of the at least one slot.

8. A skive assembly according to claim 5, further comprising a base section connected to the support member and to the plurality of ribs, where the tab section is connected to one of the base section and at least one of the rib sections, where the tab section extends into the slot.

9. A skive assembly according to claim 8, where the tab section forms an angle $\alpha$ with the base section.

10. A skive assembly according to claim 5, where the plurality of rib sections comprises a first rib section and a second rib section, the first rib section having a first slot edge, the second rib section having a second slot edge, the first and second slot edges forming the angled slot portion.

11. A skive assembly according to claim 10, where at least one of the first slot edge and the second slot edge has a straight segment and an angled segment.

12. A skive assembly according to claim 10, where the plurality of rib sections comprises a first rib section and a second rib section, the first rib section having a first slot edge, the second rib section having a second slot edge, where the first slot edge has a first straight segment at an angle $\beta$ to a first angled segment, where the second slot edge has a straight segment at an angle $\beta'$ to a second angled segment, and where the first and second angled segments form the angled slot portion.

13. A skive assembly according to claim 12, where at least one of angle $\beta$ and angle $\beta'$ is greater than about two degrees.

14. A skive assembly according to claim 12, where at least one of angle $\beta$ and angle $\beta'$ is in the range of about five degrees through about 20 degrees.

15. A skive assembly according to claim 12, where at least one of angle $\beta$ and angle $\beta'$ is about 13 degrees.

16. A skive assembly for a fuser station in an image-forming machine, comprising:

a support member; and a plurality of rib sections connected to the support member, the plurality of rib sections forming at least one slot, where the at least one slot is configured to provide an airflow pattern to reduce condensation on the skive assembly, further comprising an insert prevention device disposed in the at least one slot, where the insert prevention device is a tab section, further comprising a base section connected to the support member and to the plurality of ribs, where the tab section is connected to one of the base section and at least one of the rib sections, where the tab section extends into the slot, where the tab section forms an angle $\alpha$ with one of the rib sections.

17. A skive assembly according to claim 16, where the angle $\alpha$ is greater than about five degrees.

18. A skive assembly according to claim 16, where the angle $\alpha$ is in the range of about 15 degrees through about 45 degrees.

19. A skive assembly according to claim 16 where the angle $\alpha$ is about 30 degrees.

20. A vented fuser station for an imaging-forming machine, comprising:

a pressure roller;

a fuser roller disposed to form a nip region with the pressure roller; and a skive assembly operatively disposed to engage a sheet advancing out of the nip region in a sheet direction, where the skive assembly has at least one finger portion with a plurality of rib sections forming at least one slot, where the plurality of rib sections projects from the skive assembly toward the nip region, and where the at least one slot is configured to provide an airflow pattern that reduces condensation on the skive assembly, where the at least one finger portion further comprises an insert prevention device disposed in the at least one slot.

21. A vented fuser station for an image-forming machine, comprising:

a pressure roller;

a fuser roller disposed to form a nip region with the pressure roller; and a skive assembly operatively disposed to engage a sheet advancing out of the nip region in a sheet direction, where the skive assembly has at least one finger portion with a plurality of rib sections forming at least one slot, where the plurality of rib sections projects from the skive assembly toward the nip region, and where the at least one slot is configured to provide an airflow pattern that reduces condensation on the skive assembly, where an insert prevention device comprises at least one of a tab section and an angled slot portion.

22. A vented fuser station according to claim 21, where the tab section is connected to one of the base section and at least one rib section, where the tab section extends into the slot, and where the tab section forms a first angle with the base section.

23. A vented fuser station according to claim 21, where the tab section forms a first angle with the sheet direction.

24. A vented fuser station according to claim 23, where the first angle is greater than about five degrees.

25. A vented fuser station according to claim 21, where the angled slot portion is formed by first and second slot edges, the first slot edge provided by a first rib section, the second slot provided by a second rib section, and where at least one of the first and second slot edges has a straight segment at a second angle to an angled segment.

26. A vented fuser station according to claim 21, where the plurality of rib sections has a first rib section and a second rib section, the first rib section having a first straight segment and a first angled segment, the second rib section having a second straight segment and a second angled segment, where the angled slot portion is formed by first and second angled segments.

27. A vented fuser station according to claim 26, where at least one of the straight segments forms a second angle with at least one of the angled segments.

28. A vented fuser station according to claim 27, where the second angle is greater than about two degrees.

29. A vented fuser station in an image-forming machine, comprising:

a pressure roller;

a fuser roller disposed to form a nip region with the pressure roller; and a skive assembly operatively disposed to engage a sheet advancing out of the nip region in a sheet direction, where the skive assembly has a plurality of rib sections forming a plurality of slots, where the plurality of slots are configured to provide an airflow pattern that reduces condensation on the skive assembly, where the skive assembly further comprises a support member, where a finger assembly has an upper section connected to the support member, where the finger assembly has a base section connected to the support member, and where the plurality of rib sections are connected to the base section and to the upper section.

30. A vented fuser station in an image-forming machine, comprising:

a pressure roller;

a fuser roller disposed to form a nip region with the pressure roller; and a skive assembly operatively disposed to engage a sheet advancing out of the nip region in a sheet direction, where the skive assembly has a plurality of rib sections forming a plurality of slots, where the plurality of slots are configured to provide an airflow pattern that reduces condensation on the skive assembly, where the plurality of slots comprises a first group of slots and a second group of slots, where the first group of slots is essentially aligned with the sheet direction, and where the second group of slots is at an angle with the sheet direction.

31. A vented fuser station according to claim 30, where one of the first and second groups comprises at least one slot.

32. A vented fuser station in an image-forming machine, comprising:

a pressure roller;

a fuser roller disposed to form a nip region with the pressure roller; and a skive assembly operatively disposed to engage a sheet advancing out of the nip region in a sheet direction, where the skive assembly has a plurality of rib sections forming a plurality of slots, where the plurality of slots are configured to provide an airflow pattern that reduces condensation on the skive assembly, where the plurality of slots comprises a first group of slots and a second group of slots, and where each slot in the first group of slots has an inset prevention device.

33. A vented fuser station according to claim 32, where the first group of slots is disposed in at least one area corresponding to a side edge position of the sheet.

34. A vented fuser station according to claim 33, where a sheet passing through the vented fuser station is center aligned.

35. A vented fuser station according to claim 33 where a sheet passing through the vented fuser station is edge aligned.

36. A vented fuser station in an image-forming machine, comprising:

a pressure roller;

a fuser roller disposed to form a nip region with the pressure roller, and a skive assembly operatively disposed to engage a sheet advancing out of the nip region in a sheet direction, where the skive assembly has a plurality of rib sections forming a plurality of slots, where the plurality of slots are configured to provide an airflow pattern that reduces condensation on the skive assembly, where the skive assembly has an insert prevention device disposed in at least one slot of the plurality of slots.

37. A vented fuser station according to claim 36, where the insert prevention device comprises at least one of a tab section and an angled slot portion.

38. A vented fuser station according to claim 37, where the plurality of rib sections are connected to at least one base section, where the tab section forms a first angle with the base section.

39. A vented fuser station according to claim 37, where the tab section forms a first angle with the sheet direction.

40. A vented fuser station according to claim 39, where the first angle is greater than about five degrees.

41. A vented fuser station according to claim 37, where the angled slot portion is formed by first and second slot edges, the first slot edge provided by a first rib section, the second slot edge provided by a second rib section, and where at least one of the first and second slot edges has a straight segment at a second angle to an angled segment.

42. A vented fuser station according to claim 37, where the plurality of rib sections comprises a first rib section and a second rib section, the first rib section having a first slot edge, the second rib section having a second slot edge, where the first slot edge has a first straight segment at a second angle to a first angled segment, where the second slot edge has a straight segment at a second angel to a second angled segment, and where the first and second angled segments form the angled slot portion.

43. A vented fuser station according to claim 42, where the second angle is greater than about two degrees.

44. An image-forming machine with a vented fuser station, comprising:

a photoconductor;

a primary charger operatively disposed to electrostatically charge the photoconductor;

an exposure machine operatively disposed to optically expose and form an electrostatic image on the photoconductor;

a toning station operatively disposed to apply toner on the photoconductor, the toner having a charge to adhere to the electrostatic image;

a transfer charger operatively disposed adjacent to the photoconductor, the transfer charger to transfer the toner from the photoconductor onto a sheet; and a fuser station operatively disposed to receive the sheet from the transfer charger, the fuser station to fuse the toner onto the sheet, where the fuser station includes, a pressure roller;

a fuser roller disposed to form a nip region with the pressure roller; and a skive assembly operatively disposed to engage the sheet advancing out of the nip region in a sheet direction, the skive assembly having at least one finger portion with a plurality of rib sections forming at least one slot, where the at least one slot is configured to provide an airflow pattern that reduces condensation on the skive assembly, where the at least one finger portion further comprises an insert prevention device disposed in the at least one slot.

45. An image-forming machine-according to claim 44, where the insert prevention device comprises at least one of a tab section and an angled slot portion.

46. An image forming machine according to claim 45, where the tab section forms a first angle with the sheet direction.

47. An image-forming machine to claim 46, where the first angle is greater than about five degrees.

48. An image-forming machine according to claim 45, where the plurality of rib sections has a first rib section and a second rib section, the first rib section having a first straight segment and a first angled segment, the second rib section having a second straight segment and a second angled segment, where the angled slot portion is formed by first and second angled segments.

49. An image forming machine according to claim 45, where the angled slot portion is formed by first and second slot edges, the first slot edge provided by a first rib section, the second slot provided by a second rib section, and where at least one of the first and second slot edges has a straight segment at a second angle to an angled segment.

50. An image-forming machine according to claim 49, where the second angle is greater than about two degrees.

* * * * *